US007712545B2

(12) United States Patent
Voimanen et al.

(10) Patent No.: US 7,712,545 B2
(45) Date of Patent: May 11, 2010

(54) TELESCOPIC FEED BEAM FOR ROCK DRILL

(75) Inventors: Janne Voimanen, Ylöjärvi (FI); Juha Piipponen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 57 days.

(21) Appl. No.: 11/579,799

(22) PCT Filed: May 30, 2005

(86) PCT No.: PCT/FI2005/050183

§ 371 (c)(1),
(2), (4) Date: Nov. 7, 2006

(87) PCT Pub. No.: WO2005/116390

PCT Pub. Date: Dec. 8, 2005

(65) Prior Publication Data

US 2007/0227752 A1 Oct. 4, 2007

(30) Foreign Application Priority Data

May 31, 2004 (FI) ..... 20045196

(51) Int. Cl.
*E21B 3/02* (2006.01)

(52) U.S. Cl. ..... 173/141; 173/31; 173/32; 173/34; 173/35; 173/184; 173/160; 173/152; 175/122; 175/203; 175/220

(58) Field of Classification Search ..... 173/141, 173/184, 31, 32, 34, 35, 160, 152; 175/122, 175/203, 220
See application file for complete search history.

(56) References Cited

U.S. PATENT DOCUMENTS

| | | | | | |
|---|---|---|---|---|---|
| 3,181,623 | A | | 5/1965 | Lindgren | |
| 3,744,575 | A | | 7/1973 | Strommes | |
| 3,980,144 | A | * | 9/1976 | Roos et al. | 173/160 |
| 4,226,559 | A | * | 10/1980 | Prebensen | 405/303 |
| 4,251,046 | A | | 2/1981 | Walmsley et al. | |
| 4,264,051 | A | | 4/1981 | Walmsley et al. | |
| 4,537,263 | A | * | 8/1985 | Bjor | 173/1 |
| 4,553,612 | A | * | 11/1985 | Durham | 175/122 |
| 4,757,866 | A | * | 7/1988 | Szoke | 173/152 |
| 5,333,839 | A | * | 8/1994 | Lonardi et al. | 266/45 |
| 5,701,962 | A | * | 12/1997 | Jantunen | 175/24 |
| 5,884,712 | A | * | 3/1999 | Hakkinen | 173/11 |
| 6,009,957 | A | * | 1/2000 | Esko et al. | 173/4 |

(Continued)

FOREIGN PATENT DOCUMENTS

| | | |
|---|---|---|
| WO | 95/18912 | 7/1995 |

(Continued)

*Primary Examiner*—Rinaldi I. Rada
*Assistant Examiner*—Michelle Lopez
(74) *Attorney, Agent, or Firm*—Drinker Biddle & Reath LLP

(57) ABSTRACT

A telescopic feed beam for a rock drill includes a lower beam and an upper beam arranged to move with respect to each other in the longitudinal direction. The cross section of the lower beam is such that there is a groove-like open space at the bottom of the lower beam and a transfer cylinder between the lower beam and the upper beam is mounted in the groove.

3 Claims, 4 Drawing Sheets

U.S. PATENT DOCUMENTS

| | | | | |
|---|---|---|---|---|
| 6,105,684 | A * | 8/2000 | Pointer et al. | 173/27 |
| 6,796,388 | B2 * | 9/2004 | O'Meley | 173/152 |
| 6,814,155 | B1 * | 11/2004 | Nielson et al. | 173/152 |
| 6,880,453 | B2 * | 4/2005 | Weixler | 92/161 |

FOREIGN PATENT DOCUMENTS

| | | |
|---|---|---|
| WO | 95/18913 | 7/1995 |
| WO | WO 2004074626 A1 * | 9/2004 |

* cited by examiner

TELESCOPIC FEED BEAM FOR ROCK DRILL

BACKGROUND OF THE INVENTION

The invention relates to a telescopic feed beam for a rock drill, the feed beam comprising a lower beam and an upper beam arranged on top of each other and parallel with each other in the longitudinal direction, whereby the rock drill is arranged to be installed movably in the upper beam in its longitudinal direction and a transfer cylinder is arranged to act between the upper beam and the lower beam to move the upper and the lower beam with respect to each other in the longitudinal direction.

Rock drilling devices are frequently used in various drilling situations. Thus it is sometimes necessary to drill short holes in confined spaces and longer holes when space permits. This cannot be done by using conventional feed beams, for which reason different drilling devices are normally used for various purposes. Sometimes it is, however, necessary to use the same drilling device for drilling holes in different conditions. For this purpose, various telescopic beams have been developed where the feed beam is formed by two feed beam sections that move with respect to each other in the longitudinal direction, i.e. an upper beam, along which the rock drill moves, and a lower beam. In this case, the upper beam and the lower beam are typically coupled by means of slide rails and slide pads to move with respect to each other in the longitudinal direction. When drilling takes place in confined spaces, the feed beam sections are arranged to overlap to as great an extent as possible to achieve as short a total length as possible. On the other hand, when longer holes are drilled, the feed beam sections are moved with respect to each other to achieve as long a feed beam as possible. In that case, longer drill rods are naturally employed in the drilling. As the drillings proceeds, the drill rod penetrates into rock, in which case the length of the feed beam is first shortened typically by moving the farther feed beam section in the drilling direction. After this feed beam section has moved onto the top of the other feed beam section so that the feed beam is at its shortest, the rock drill is moved along the feed beam section to allow the utilization of the whole drill rod length. A pressure medium operated transfer cylinder is rather commonly used to provide the movement between the feed beams, the cylinder being coupled between the feed beam sections so that when the piston of the transfer cylinder is moved with respect to the cylinder, the feed beam sections move with respect to each other. Such a solution is known from Finnish patent no. 97253, for instance.

Prior art feed beam solutions involve various practical problems; for example, it is difficult to carry out servicing because of the confined space available in the feed beams. Furthermore, if the transfer cylinder is installed in the space between the feed beam sections to protect it from dirt and mechanical stress and the feed beam is installed at the end of the boom of a rock drilling device, it may not be that easy to service and, if necessary, to repair or replace the transfer cylinder. Nowadays, in particular, more attention is paid to the quickness and ease of service to minimize losses in the productive time of a rock drilling device. It is thus necessary to find new solutions for achieving this.

BRIEF DESCRIPTION OF THE INVENTION

The object of the present invention is to provide a feed beam where a transfer cylinder between the feed beam sections is relatively well protected on the one hand, but on the other, the necessary service and repair operations can be carried out relatively easily and quickly.

The feed beam of the invention is characterized in that the lower beam has a cross section comprising an open groove-like space at the bottom of the lower beam, that the transfer cylinder between the lower beam and the upper beam is mounted in the groove so that it is protected from material falling from the top and sides of the feed beam and from impacts directed at the feed beam.

The invention is based on the idea that the lower beam of the feed beam is provided with a cross section comprising a downwardly open space at the bottom of the lower beam, where the transfer cylinder between the feed beam sections can be mounted. According to a preferred embodiment of the invention, the feed beam is installed movably in its longitudinal direction with respect to a cradle installed at one end of the boom of the rock drilling device, and the second transfer cylinder between the cradle and the feed beam as well as one end of the transfer cylinder between the feed beams are coupled to a separate connection piece attached to the lower beam so that the forces acting on the feed beam are transmitted through the connection piece.

An advantage of the invention is that both the top and the sides of the transfer cylinder are well protected but when the transfer cylinder needs to be serviced or checked, it is easily accessible through an opening provided at the bottom of the feed beam.

BRIEF DESCRIPTION OF THE FIGURES

The invention will be described in greater detail in the attached drawings, in which.

DETAILED DESCRIPTION OF THE INVENTION

Figure 1:
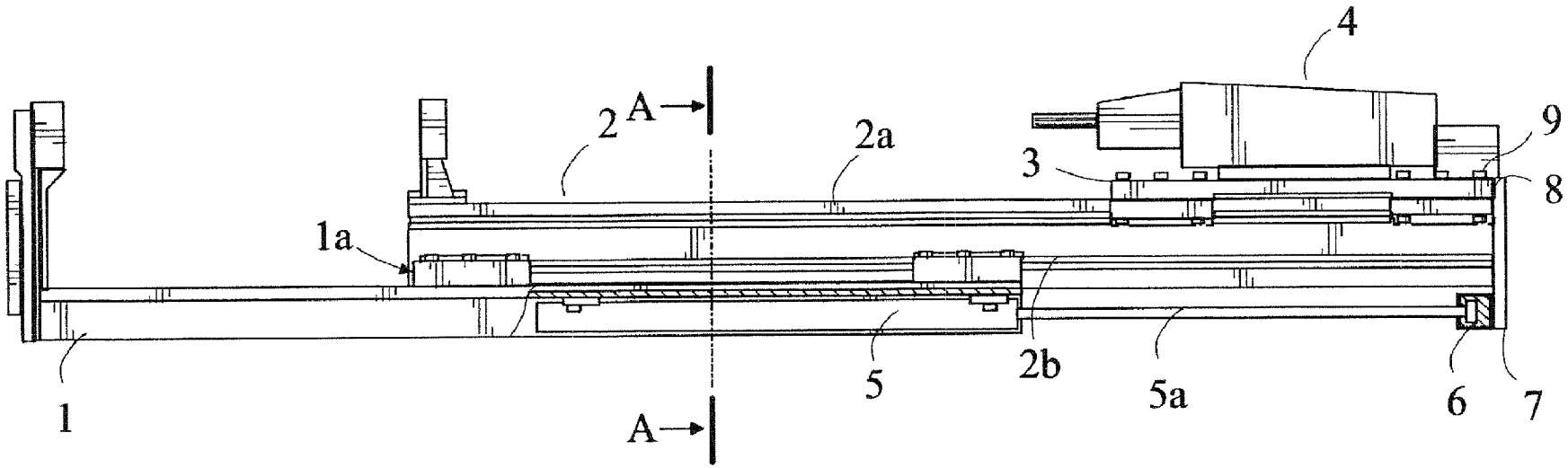
FIG. 1 is a schematic and partly cross-sectional side view of an embodiment of a feed beam according to the invention, FIG. 2 schematically illustrates a cross section of the feed beam according to FIG. 1 at point A-A.

FIG. 1 is a schematic and partly cross-sectional side view of a feed beam according to the invention. The feed beam comprises two parts, i.e. a lower beam 1 and an upper beam 2, which move with respect to each other in their longitudinal direction. The lower beam is connected to the boom of a rock drilling device directly or through various joints and/or a cradle. A drill carriage 3, to which the rock drill 4 is coupled, normally moves on top of the upper beam 2. The drill carriage 3 of the rock drill is arranged to slide with respect to the upper beam 2 on slide rails 2*a* provided therein as shown in greater detail in FIG. 2, for example. The rock drill 4 and the drill carriage 3 may also form a uniform entity, although this has no essential significance to the present invention. The rock drill moves back and forth in the longitudinal direction of the upper beam 2 by means of a separate feeding mechanism, which is not shown. Such various feeding mechanisms are known per se to a person skilled in the art, for which reason they need not be described in greater detail.

Figure 2:
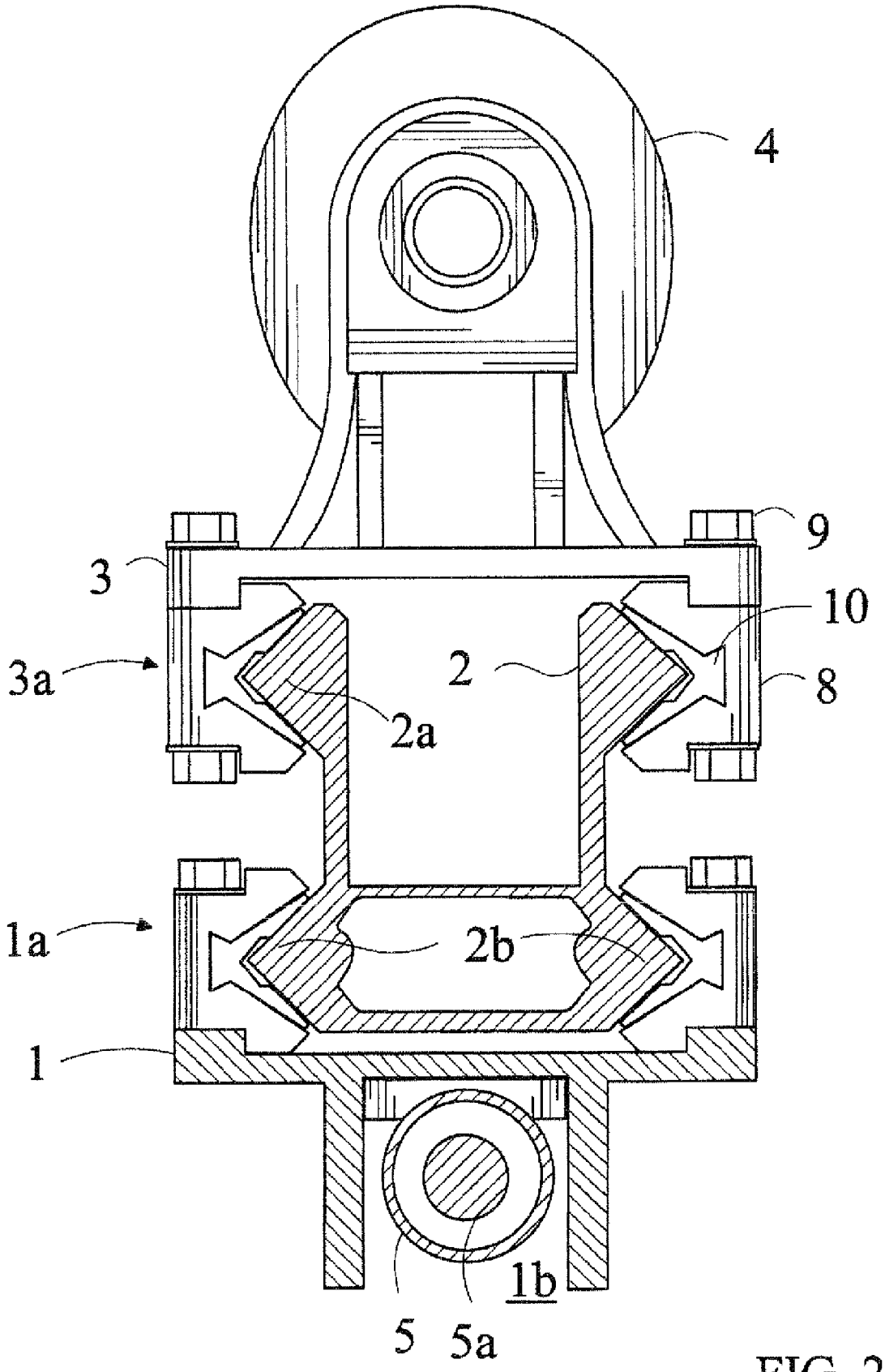

The upper beam 2 and the lower beam 1 are arranged to slide with respect to each other by means of second rails 2*b* provided in the upper beam 2 and slide members 1*a* fixed to the lower beam 1 as shown more closely in FIG. 2. In a downwardly open groove (1*b*) of the lower beam, there is a transfer cylinder 5, which is attached immovably to the lower beam 1 in the case illustrated in FIG. 1. One end of the transfer cylinder's rod 5*a* is coupled immovably in the longitudinal direction to an connection piece 6 connected to the end of the upper beam 2. The connection piece 6 is coupled to a plate 7 attached to the end of the upper beam 2 so that the upper beam 2 and the connection piece 6 are substantially immovable with respect to each other. It is naturally obvious that the connection piece 6 can be fixed directly to the upper beam 2. While the piston of the transfer cylinder 5 is moved inside the transfer cylinder 5 leftwards from the situation shown in FIG. 1, the visible piston rod 5*a* shortens and, as a result of this, the upper beam 2 and the lower beam 1 move with respect to each other so that the total length of the feed beam decreases. Correspondingly, when pressure medium is fed from the opposite end of the feed cylinder 5, the piston moves towards the situation illustrated in FIG. 1, increasing the length of the feed beam.

FIG. 2 schematically illustrates a cross section of the feed beam according to FIG. 1 along line A-A. It shows that the upper beam 2 is formed of a profile whose upper and lower sections are provided with slide rails 2*a* and 2*b*, respectively. The upper beam 2 is most preferably made of a light metal profile, where the slide rails 2*a* and 2*b* have been formed upon the extrusion of the profile. The surface of the slide rails 2*a* and 2*b* may be provided with separate slide surfaces made of a harder material in a manner known per se, but such are not shown here for the sake of clarity. Slide pad frames 8 included in the slide members 3*a* are attached to the drill carriage 3 of the drilling machine 4 by bolts 9. Between the slide pad frames 8 and the slide rails 2*a*, there are slide pads 10 made of a suitable material, such as polyurethane, on which the drill carriage moves along the upper beam 2. The lower beam 1 is coupled to move along the slide rails 2*b* of the upper beam 2 preferably by the same slide member structures as the drill carriage of the drilling machine. Thus all the slide structures of the feed beam can be implemented by the same spare parts. Such slide member structures and their function are known per se from U.S. Pat. No. 5,704,716, for example, for which reason they need not be described in greater detail.

The lower beam 1 and the upper beam 2 thus move with respect to each other in their longitudinal direction. As FIG. 1 shows, a transfer cylinder 5 acts between the lower beam 1 and the upper beam 2. The transfer cylinder 5 is mounted in a downwardly open groove 1*b* provided in the lower beam 1 so that its top and sides are covered to prevent the material falling onto the top of the feed beam from ending on top of the transfer cylinder 5 and damaging it in any way. In the embodiment shown in FIGS. 1 and 2, the transfer cylinder 5 is coupled immovably to the lower beam 1 and one end of the cylinder rod 5*a* is connected to the connection piece 6 at the end of the upper beam 2 so that the end of the cylinder rod 5*a* is immovable with respect to the upper beam 2 in its longitudinal direction and can thus move the upper beam 2 with respect to the lower beam 1.

Figure 3:
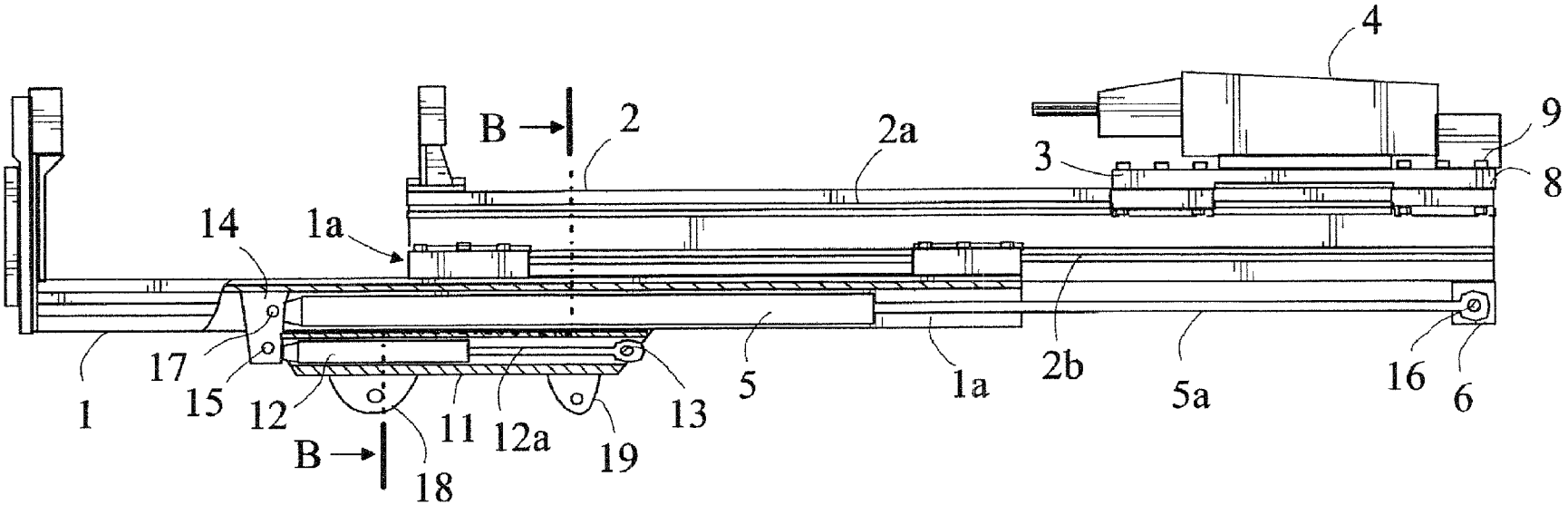
FIG. 3 is a schematic and partly cross-sectional side view of another embodiment of a feed beam according to the invention, and FIG. 4 schematically illustrates a cross section of the feed beam according to FIG. 3 along line B-B.

FIG. 3 is a schematic and partly cross-sectional side view of another embodiment according to the invention. This embodiment corresponds to the one shown in FIGS. 1 and 2, except that in addition to the lower beam 1 and the upper beam 2, it includes a cradle 11, with respect to which the lower beam 1 is arranged to move in its longitudinal direction. To allow the lower beam 1 to move with respect to the cradle 11, the lower beam 1 is also provided with slide rails 1*b*, which are preferably formed in the lower beam 1 upon the extrusion of the profile in the same way as the slide rails 2*a* and 2*b* in the upper beam 2. The cradle 11 is most preferably coupled to the lower beam 1 in the same manner as the drill carriage 3 to the upper beam 2 and the lower beam 1 and the upper beam 2 with respect to each other, i.e. by means of separate slide pad frames and slide pads forming the slide members 11 shown in FIG. 4.

A second transfer cylinder 12 is arranged between the cradle 11 and the lower beam 1. In the case exemplified in FIG. 3, one end of the piston rod 12*a* of the transfer cylinder 12 is coupled to the cradle 11 by means of a joint pin or the like. The other end of the cylinder 12 is coupled to a separate connection piece 14 by a joint pin or the like 15. The transfer cylinder 5 between the lower beam and the upper beam is also coupled so that the cylinder rod 5*a* is coupled to the connection piece 6 by a joint pin 16 and one end of the transfer cylinder 5 is coupled to the connection piece 14 by a joint pin 17. In that case, the lower beam 1 can be moved with respect to the cradle 11 and the upper beam 2 with respect to the lower beam 1 by increasing or decreasing the length of the transfer cylinders so that forces are transmitted from the cylinders through the connection piece 14, in which case they do not load and thus bend the lower beam 1 during the operation. In this embodiment, the connection piece 6 is fixed directly to the upper beam 2.

The boom of the rock drilling machine is coupled to a lug 18 provided in the cradle. Correspondingly, the cylinder whose one end is connected to the boom not shown and which is needed to direct the feed beam is coupled to a second lug 19. Such booms and the devices and couplings between the cradle and the boom of the rock drilling device are fully known per se and thus need not be described here.

Figure 4:
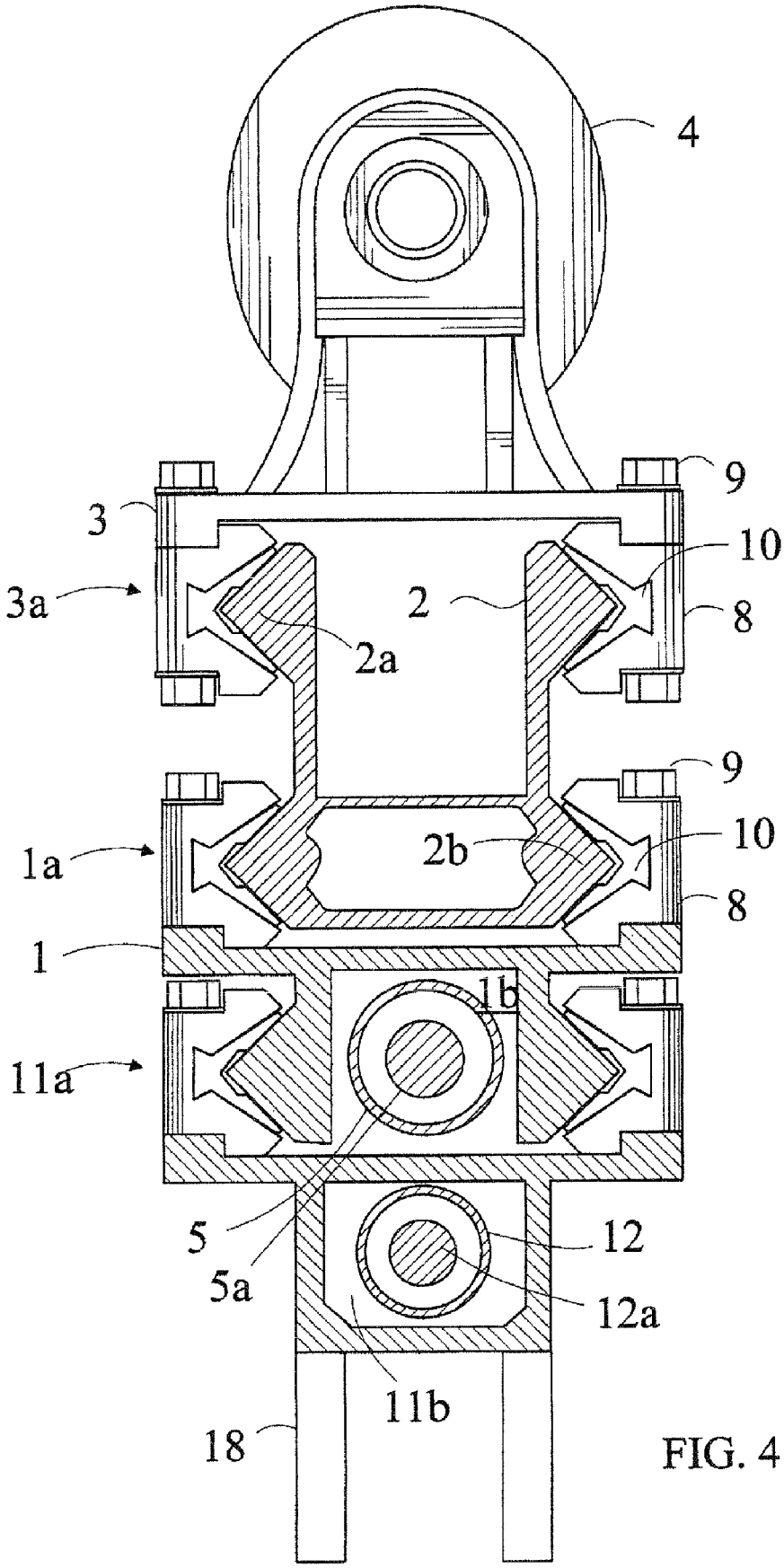

FIG. 4 schematically illustrates a cross section of the feed beam shown in FIG. 3 along line B-B. It shows that the cradle 11 is coupled to move with respect to the slide rails 1*b* of the lower beam by means of slide pad frames 8 and slide pads 9 that form slide members 11*a*. It can further be seen that the transfer cylinder 5 between the lower beam 1 and the upper beam 2 is still in the downwardly open groove of the lower beam 1, thus being protected from the material falling from the top and sides as well as from impacts. The second transfer cylinder 12 is covered in a tubular space 11*b* inside the cradle 11.

Even though the invention was described above with reference to the example according to the enclosed drawings, it is clear that the invention is not in any way restricted thereto. It is essential that the lower beam comprise a groove-like space with an open bottom but covered top and sides, where the transfer cylinder between the lower beam and the upper beam can be installed to protect it as much as possible; yet the cylinder is easily accessible during service and repair. An idea underlying the preferred embodiment of the invention is that the transfer cylinder between the lower beam and the upper beam as well as the transfer cylinder between the lower beam and the cradle coupled slidingly to the lower beam in its longitudinal direction are arranged to act on the lower beam through a separate connection piece, through which all the forces are transmitted to the lower beam and from the lower beam to the transfer cylinders.

The invention claimed is:

1. A telescopic feed beam for a rock drill comprising a lower beam and an upper beam, which are arranged in parallel and slidable with each other in the longitudinal direction, the rock drill being arranged to be movably installed in the upper beam in its longitudinal direction and a transfer cylinder connected to the upper beam and being arranged to act between the upper beam and the lower beam to move the upper beam and the lower beam with respect to each other in the longitudinal direction, wherein the lower beam has a cross section comprising a groove-like space at the bottom of the lower beam, that the transfer cylinder between the lower beam and the upper beam is mounted in the space so that it is protected from material falling from the top and sides of the feed beam and from impacts directed at the feed beam, a cradle coupled to move slidingly with respect to the lower beam in its longitudinal direction, a second transfer cylinder arranged to act between the cradle and the lower beam to move the cradle and the lower beam with respect to each other, wherein the feed beam comprises a first connection piece connected to the lower beam, that one end of the transfer cylinder between the lower beam and the upper beam is coupled to the upper beam via a second connection piece and the other end to the first connection piece, and that one end of the second transfer cylinder is correspondingly coupled to the first connection piece, and the other end to the cradle.

2. A feed beam according to claim 1, wherein the upper beam comprises slide rails and the lower beam comprises slide members for the slide rails.

3. A feed beam according to claim 2, wherein the slide members are slide pads.

* * * * *